US010418706B1

(12) United States Patent
Lee et al.

(10) Patent No.: US 10,418,706 B1
(45) Date of Patent: Sep. 17, 2019

(54) CIRCULAR POLARIZED MICROSTRIP ANTENNA USING A SINGLE FEED

(71) Applicant: Southern Methodist University, Dallas, TX (US)

(72) Inventors: Choon Sae Lee, Dallas, TX (US); Yang Fan, Dallas, TX (US)

(73) Assignee: Southern Methodist University, Dallas, TX (US)

( * ) Notice: Subject to any disclaimer, the term of this patent is extended or adjusted under 35 U.S.C. 154(b) by 0 days.

(21) Appl. No.: 15/214,123

(22) Filed: Jul. 19, 2016

(51) Int. Cl.
*H01Q 9/04* (2006.01)
*H01Q 1/36* (2006.01)

(52) U.S. Cl.
CPC ..... *H01Q 9/0407* (2013.01); *H01Q 1/36* (2013.01); *H01Q 9/045* (2013.01)

(58) Field of Classification Search
CPC ..... H01Q 1/38; H01Q 9/0407; H01Q 9/045; H01Q 19/005
USPC ..... 343/700 MS
See application file for complete search history.

(56) References Cited

U.S. PATENT DOCUMENTS 5,461,393 A * 10/1995 Gordon ..... H01Q 9/0407 343/700 MS
5,471,221 A * 11/1995 Nalbandian ..... H01Q 1/38 333/134
5,515,057 A * 5/1996 Lennen ..... H01Q 1/243 342/357.27
5,703,601 A * 12/1997 Nalbandian ..... H01Q 9/0414 343/700 MS
6,157,348 A * 12/2000 Openlander ..... H01Q 1/38 343/700 MS
6,166,692 A * 12/2000 Nalbandian ..... H01Q 9/0414 343/700 MS
6,232,923 B1 * 5/2001 Guinn ..... H01Q 1/38 343/700 MS
2010/0194663 A1 * 8/2010 Rothwell ..... H01Q 9/0407 343/876
2015/0303576 A1 * 10/2015 Latrach ..... H01Q 1/2208 343/700 MS
2016/0118720 A1 * 4/2016 Kim ..... H01Q 1/3275 343/700 MS
2016/0261039 A1 * 9/2016 Parsche ..... H01Q 1/526

* cited by examiner

*Primary Examiner* — Hoang V Nguyen
*Assistant Examiner* — Awat M Salih
(74) *Attorney, Agent, or Firm* — Fish & Richardson P.C.

(57) ABSTRACT

A microstrip antenna includes a dielectric substrate, a radiating plate, and a single feed connection. In these instances, the rectangular radiating plate is affixed to the dielectric substrate and having a center point, and the radiating patch defines a first aperture and a second aperture on opposite sides of the center point, each aperture having a center longitudinally aligned with the center point. The single feed connection is laterally offset from a point on a virtual line, wherein the virtual line is located between two opposite corners of the rectangular radiating patch and passes through the center point.

19 Claims, 5 Drawing Sheets

CIRCULAR POLARIZED MICROSTRIP ANTENNA USING A SINGLE FEED

TECHNICAL FIELD

This invention relates to transmitting and receiving signals, and more particularly to transmitting and receiving circular polarized radiation using a single feed.

BACKGROUND

Circularly polarized antennas are often desirable in many applications using ultra high frequency (UHF), microwave frequencies, and millimeter wave frequencies. A circularly polarized wave may be produced by radiating horizontally and vertically polarized waves ninety degrees out of phase. This is often accomplished with power dividers and ninety-degree phase shifters. However, these power divider and phase shifter components often complicate the design of circularly polarized antennas. Additionally, the extremely narrow bandwidth of prior circularly polarized antennas make them undesirable in many applications requiring moderate bandwidth. Many systems, such as military and commercial communications systems, could be improved with compact, low cost, rugged, conformable antennas. Such antennas could readily be utilized in aircraft and global positioning system receivers.

SUMMARY

In some implementations, a microstrip antenna includes a dielectric substrate, a rectangular radiating plate, and a single feed connection. In these instances, the rectangular radiating plate is affixed to the dielectric substrate and having a center point, and the radiating patch defines a first aperture and a second aperture on opposite sides of the center point, each aperture having a center longitudinally aligned with the center point. The single feed connection is laterally offset from a point on a virtual line, wherein the virtual line is located between two opposite corners of the rectangular radiating patch and passes through the center point.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
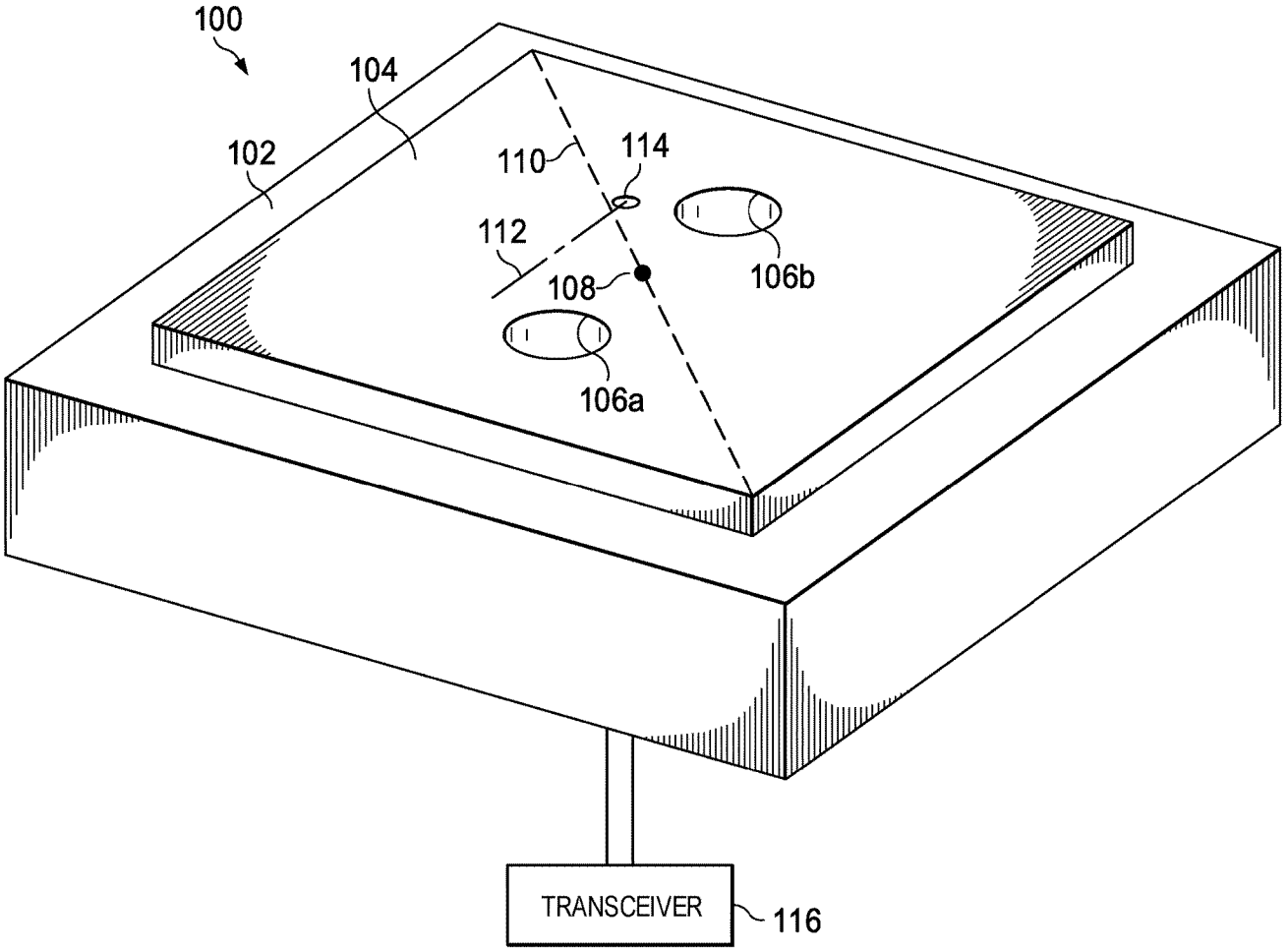
FIG. 1 is an example circularly polarized (CP) microstrip antenna.

FIG. 1 illustrates an example CP microstrip antenna 100 with a single feed. For example, the CP microstrip antenna

100 includes a single feed where the return loss and axial ratio as a function of frequency in decibels (dB) are at a minimum or below a predefined threshold. The return loss typically refers to the loss of power in a signal reflected by a load in a transmission line. The axial ratio typically refers to the ratio of magnitudes of the major and minor axis defined by the electric field vector of radiation. In the proposed device, the CP microstrip antenna 100 is based on small apertures on the radiating patch. In these instances, the apertures within the radiating patch change one of the resonant modes to give 90° out of phase compared to the other. In other words, the apertures may be arranged to produce two orthogonal degenerate modes, the phases of which are 90° apart. In this case, the feed location may determine not only the input impedance but also the relative magnitudes of the two normal modes. When properly designed, the CP microstrip antenna 100 may produce CP radiation using a single feed.

In the illustrated implementation, the CP microstrip antenna 100 includes a dielectric substrate 102 and a radiating patch 104. The radiating patch 104 is affixed to a top surface of the dielectric substrate 102. A transceiver 116 is connected to the radiating patch 104 at the feed connection 114. The transceiver 116 supplies (and receives), the radiating patch 104, RF power at a specific frequency. The radiating patch 104 generates a first mode at the specific frequency and a second mode orthogonal to the first at the specific frequency with a 90° phase shift compared to the first signal.

The radiating patch 104 includes apertures 106*a* and 106*b* that form channels to the dielectric substrate 102. As illustrated, the apertures 106*a* and 106*b* are circular but, with departing from the scope of the disclosure, may be other shapes as well (e.g., rectangular). In some implementations, the apertures 106*a* and 106*b* may have substantially the same dimensions. In the illustrated implementation, the aperture 106*a* is located between the left side and center point of the radiating patch 104, and the aperture 106*b* is located between the right side and center point of the radiating patch 104. The center of the aperture 106*a* may be longitudinally aligned with the center point 108 of the radiating patch 104, and the center of the aperture 106*b* may be longitudinally aligned with the center point 108 of the radiating patch 104. In some implementations, the center of the aperture 106*a* may be equidistant between the top side and the bottom side of the radiating patch 104. In some implementations, the center of the aperture 106*b* may be equidistant between the top side and the bottom side of the radiating patch 104.

The virtual line 110 extends from the top right corner, through the center point 108, and to the bottom left corner of the radiating patch 104. As previously mentioned, the virtual line 110 may be used to determine a point on the virtual line 110 where the measured rate loss in dB is at a minimum or otherwise below a predefined threshold. A lateral offset 112 may be determined from the point on the virtual line 110 where the axial ratio in dB is at a minimum or otherwise below a predefined threshold. In some implementations, the lateral offset 112 is substantially parallel to the top and bottom side of the radiating patch 104. As illustrated, the lateral offset 112 can determine a feed connection 114 for the transceiver 116. In some implementations, the connection for the transceiver 116 may be feed through the dielectric substrate 102.

In some aspects of operations, the feed connection 114 may be determined based on multiple measurements at different frequencies along the virtual line 110 followed by multiple measurements at different frequencies in a lateral direction away from the virtual line 110. For example, measurements over a frequency range may be made starting at the center point 108 and then along the virtual line 110 toward the upper right hand corner of the radiating patch 104. The measurements are analyzed to determine a point on the virtual line 110 where a frequency has the lowest value or a value below a predefined threshold for the measured return loss. In these implementations, measurements over the frequency range are then performed in a lateral direction starting from the point on the virtual line 110. The measurements are analyzed to determine a lateral offset where the frequency has the lowest value or a value below a predefined threshold for the axial ratio in dB. The single feed connection 114 is made using the later offset 112.

Figure 2:
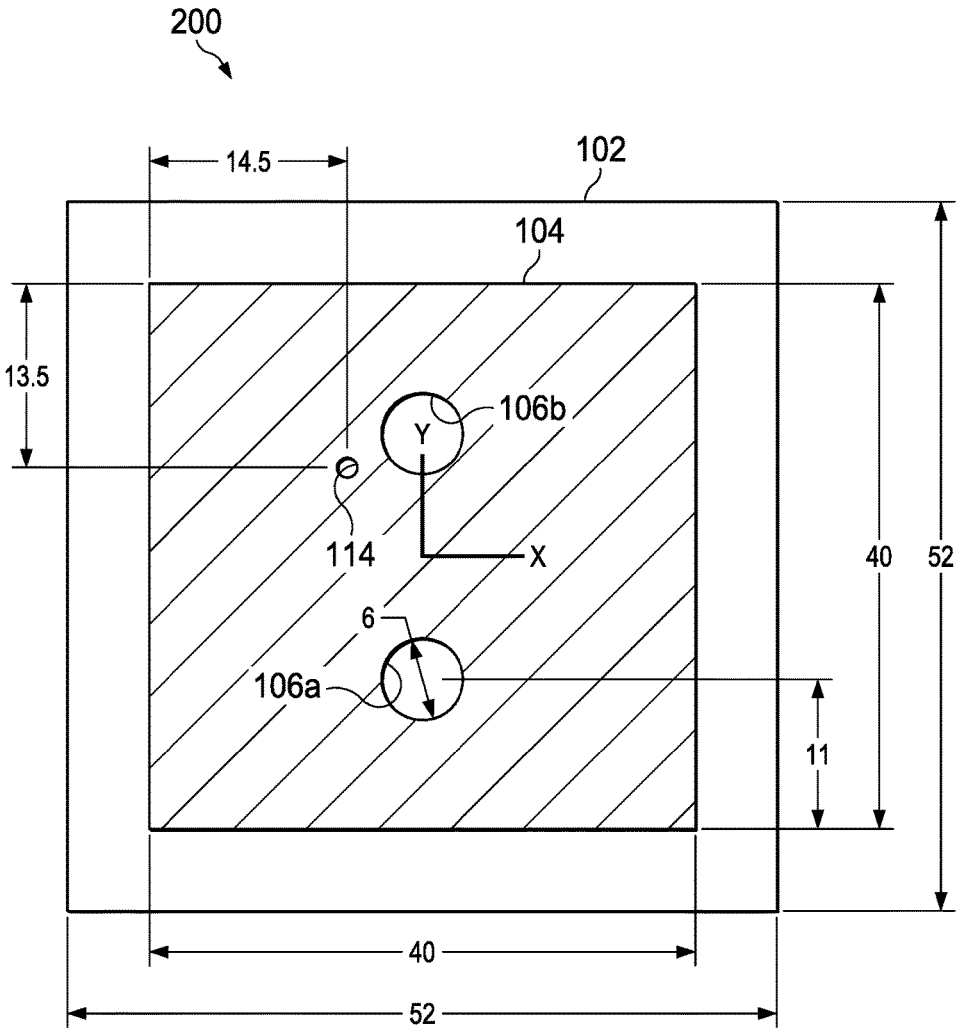
FIG. 2 is another example CP microstrip antenna.

FIG. 2 is a CP microstrip antenna 200 with a single feed. In particular, the CP microstrip antenna 200 is a specific implementation of the CP microstrip antenna 100 in FIG. 1. As illustrated, the dielectric substrate 102 and the radiating patch 104 are substantially square. The dielectric substrate 102 is 52 millimeters (mm) by 52 mm, and the radiating patch 104 is 40 mm by 40. The apertures 106*a* and 106*b* are 11 mm from their respective sides of the radiating patch 104 and are circular with centers substantially align with the center point of the radiating patch 104. The feed connection 114 is located 14.5 mm along the x axis and 13.5 mm along the y axis from the upper left corner of the radiating patch 104, which results in a y-axis offset from the diagonal of 1 mm.

The apertures 106*a* and 106*b* have centers along the y-axis, and the feed, through the feed connection 114, is placed near the diagonal line connecting two opposite corners of the radiating patch 104. In particular, the feed is offset from the diagonal along the y axis. The feed applies an oscillating current to the radiating patch 104 and excites two degenerate modes, transverse magnetic $TM_{10}$ and $TM_{01}$. The apertures 106*a* and 106*b* do not appreciably affect the modal excitation of $TM_{10}$ because the centers of the apertures 106*a* and 106*b* are placed at the line of vanishing electric field of $TM_{10}$. In contrast, the apertures 106*a* and 106*b* strongly affect modal fields of $TM_{01}$. The apertures 106*a* and 106*b* impose a boundary condition on the $TM_{01}$ mode, and the phase of the new modal excitation becomes 90° out of phase with that of $TM_{10}$.

Another condition for good CP radiation is that the magnitudes of the $TM_{10}$ and $TM_{01}$ modes have to be as close as possible each other. In order to adjust the relative magnitude of one mode over the other, the feed location is shifted. For example, as the feed moves along the y-axis with a fixed value of x, the magnitude of $TM_{01}$ changes while that of the $TM_{10}$ mode is relatively unchanged. As the feed moves toward increasing value of y, the magnitude of $TM_{01}$ will increase relative to that of $TM_{10}$.

The apertures 106*a* and 106*b* have to be large enough that the apertures 106*a* and 106*b* provide sufficient influence on the field excitation of $TM_{01}$ to provide a phase shift of 90° for CP radiation. However, excessively large aperture size may not provide a 90° phase shifter because the 90° phase shift is based on a small-hole approximation. Also, perturbation from large apertures may change the resonant frequency of $TM_{01}$, which can be detrimental to CP radiation. In order to increase the effect of the apertures 106*a* and 106*b* without any detrimental aspects of large aperture size, the apertures 106*a* and 106*b* may be symmetrically placed as illustrated. In these instances, the apertures 106*a* and 106*b* may influence the $TM_{01}$ modal excitation substantially identically.

The closer the apertures 106*a* and 106*b* are to the edges of the radiating patch 104, the apertures 106*a* and 106*b* are typically more effective on the phase shift of the modal excitation of $TM_{01}$. But as the apertures 106*a* and 106*b* approaches their respective patch edges, interaction between the apertures 106*a* and 106*b* and the patch edges increases and may reduce the quality of CP radiation. The ideal axial ratio is 1 (or 0 dB). The dB for CP may be defined to be 20 log (linear axial ratio). Typically, an acceptable axial ratio is 3 dB or 6 dB.

Figure 3:
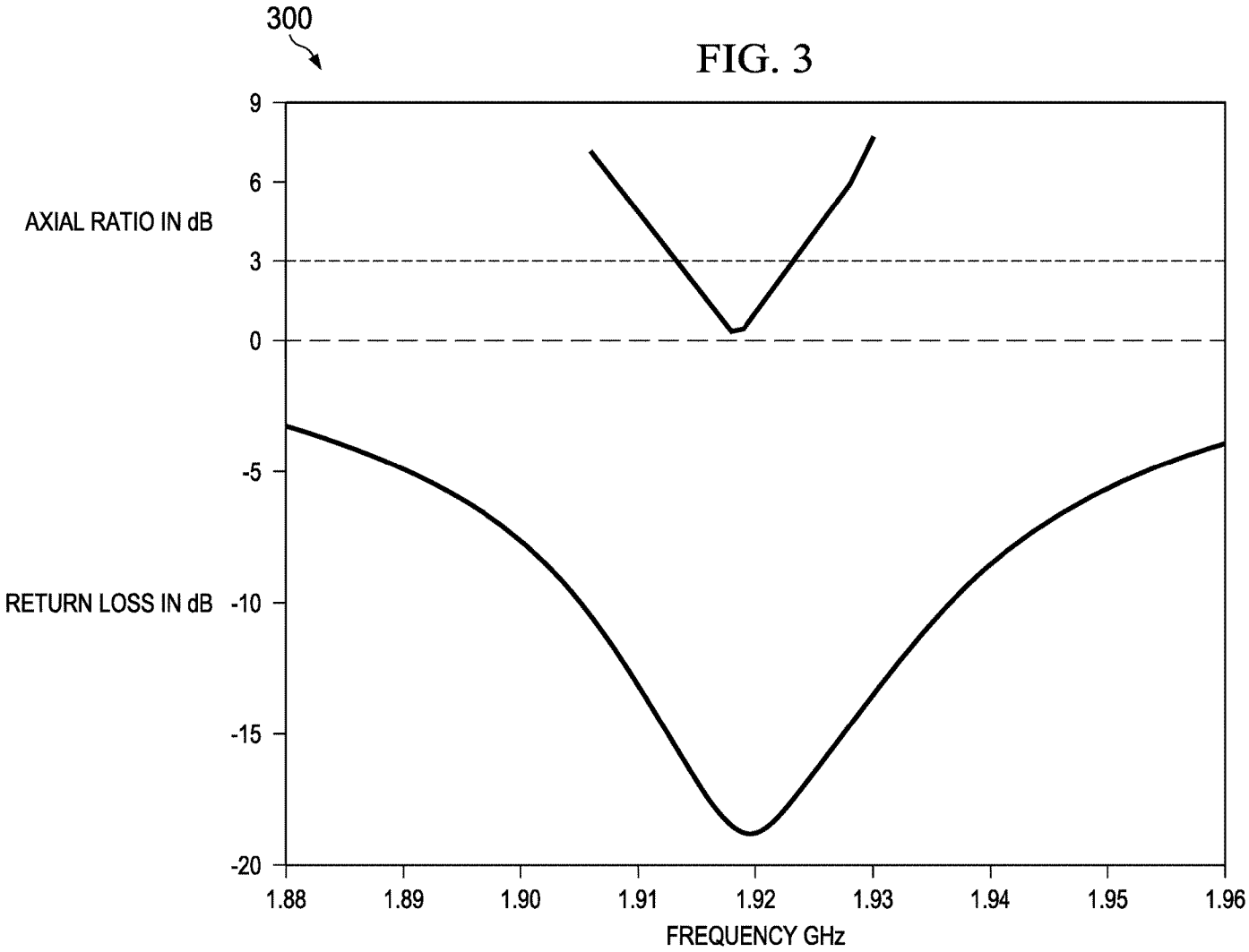
FIG. 3 is a graph of return loss and axial ratio as a function of frequency for the CP microstrip antenna of FIG. 2.

The measured return loss (RL) and the axial ratio (AR) as a function of frequency are shown in FIG. 3. The 3-dB AR bandwidth is 0.52% compared to 1.64% of the 10-dB RL bandwidth, giving 32% of the RL bandwidth for the 3-dB AR bandwidth.

Figure 4:
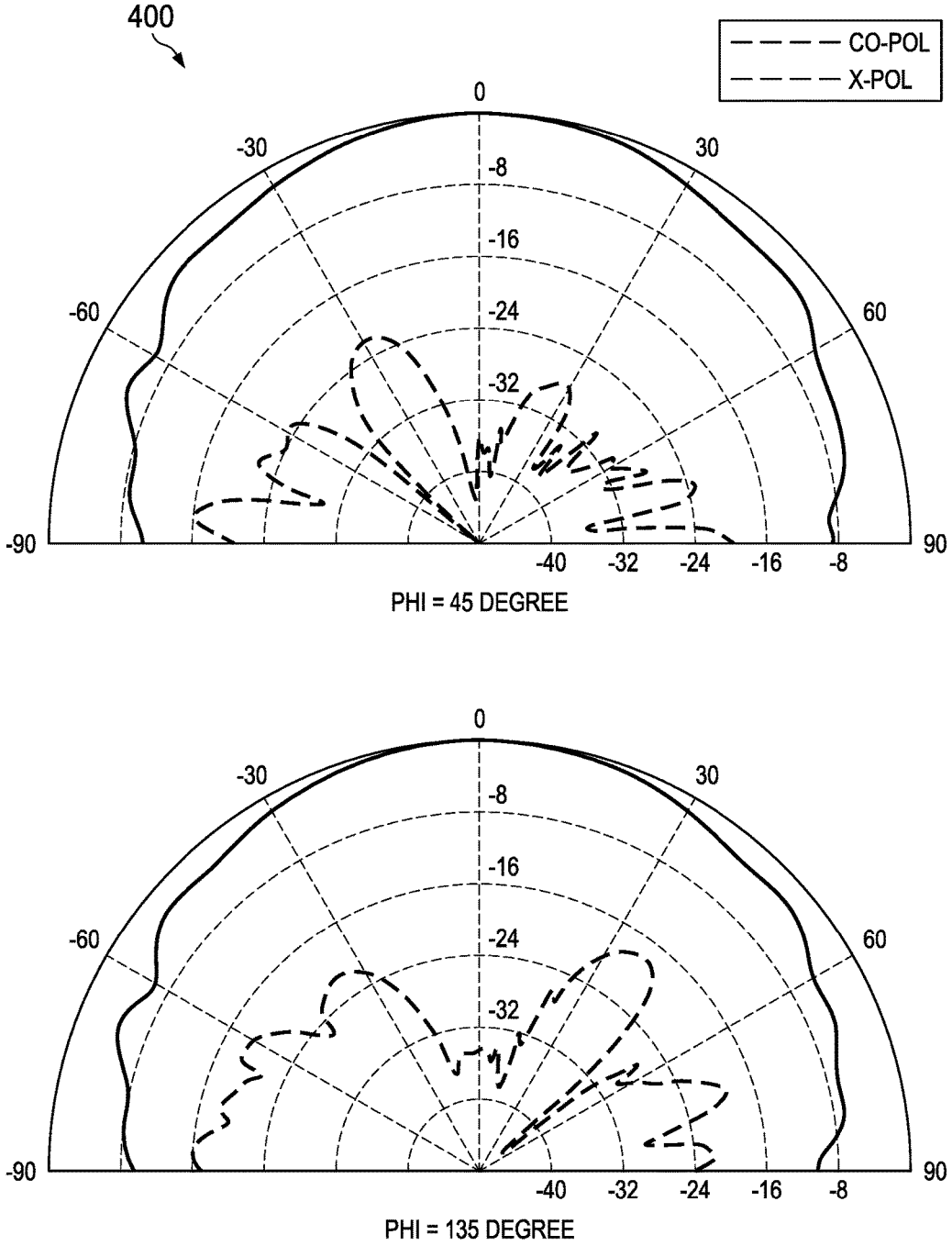
FIG. 4 is a graph of radiation patterns at resonant frequency for the CP microstrip antenna of FIG. 2.

The measured radiation patterns at the resonant frequency with an optimized AR of 0.25 dB are shown in FIG. 4, where a high CP quality is shown over a wide frequency range except in the region near and behind the ground plane. The radiation near the horizon may be influenced by scattering at the edges of the finite ground plane (52 mm×52 mm), and the CP quality may not be as good as that of the forward radiation. As can be seen in FIG. 4, the cross-polarization level is less than −20 dB in most of forward radiation.

Figure 5:
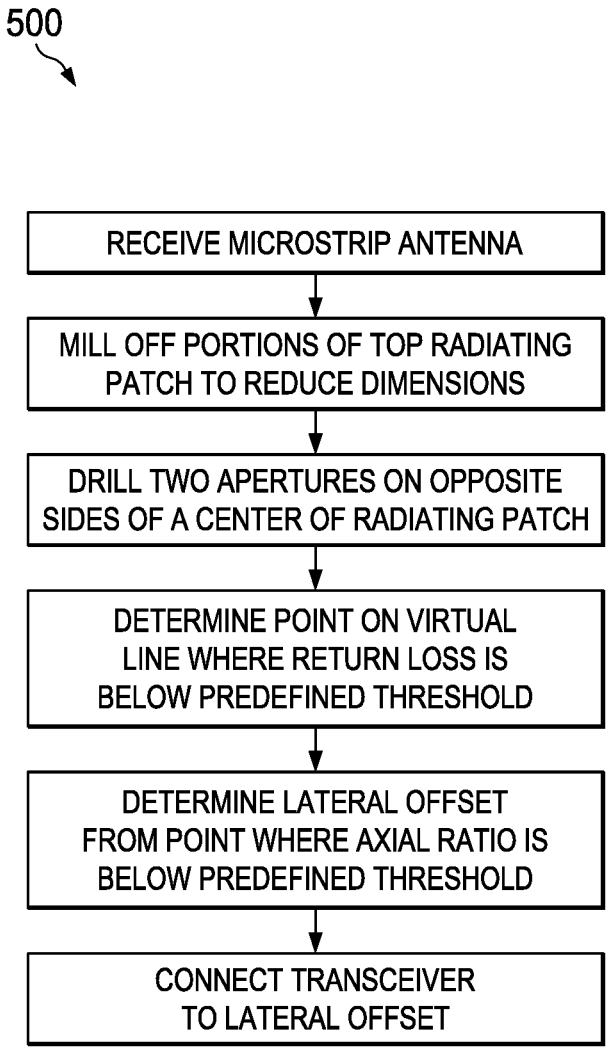
FIG. 5 is a flow chart illustrating an example method for manufacturing an example CP microstrip antenna using a single feed.

FIG. 5 is a call flow of an example method 500 for manufacturing circular polarized microstrip antenna with a single feed. Method 500 begins at step 502 wherein a microstrip antenna is received. At step 504, a portion of the top radiating patch is milled off to reduce dimensions. Next, at step 506, two apertures are drill on opposite sides of a center of the radiating patch. A point on a virtual line is determined where return loss is below a predefined threshold at step 508. At step 510, a lateral offset from the point is determined where the axial ratio is below a predefined threshold. Next, at step 512, a transceiver is connected to the lateral offset.

A number of embodiments of the invention have been described. Nevertheless, it will be understood that various modifications may be made without departing from the spirit and scope of the invention. For example, a rectangular patch slightly deviant from a square may show improved CP due to compensation of the shifted resonant frequency of first mode relative to that of the other when placing the apertures. A non-rectangular shape of the radiating patch such as a circular shape is one other variation. Another example is aperture shapes other than a circle. Accordingly, other embodiments are within the scope of the following claims.

What is claimed is:

1. A microstrip antenna, comprising:

a dielectric substrate;

a rectangular radiating plate affixed to the dielectric substrate and having a center point, wherein the rectangular radiating plate defines a first aperture and a second aperture on opposite sides of the center point, each aperture having a center longitudinally aligned with the center point; and a single feed connection laterally offset from a point on a virtual line, wherein the single feed connection is further offset from a first line that passes through the center point and that is parallel to a first side of the rectangular radiating plate, wherein the single feed connection is further offset from a second line that passes through the center point and that is parallel to a second side of the rectangular radiating plate that is perpendicular to the first side of the rectangular radiating plate, wherein the virtual line is located between two opposite corners of the rectangular radiating patch and passes through the center point and between the first aperture and the second aperture, wherein the point is configured to have a frequency below a pre-defined measured return loss value when the frequency is measured starting at the center point and then along the virtual line toward an upper right hand corner of the radiating patch, and the single feed connection is configured to have a frequency below a pre-defined threshold for axial ratio in decibels.

2. The microstrip antenna of claim 1, wherein a lateral dimension and a longitudinal dimension of the dielectric substrate are greater than a lateral dimension and a longitudinal dimension of the rectangular radiating patch.

3. The microstrip antenna of claim 1, wherein the dielectric substrate and the rectangular radiating patch are substantially square.

4. The microstrip antenna of claim 1, wherein the first aperture and the second aperture are substantially circular and have substantially equal dimensions.

5. The microstrip of claim 1, wherein the point on the virtual line is located where a measured return loss as a function of frequency is below the predefined return-loss value.

6. The microstrip antenna of claim 5, wherein the point on the virtual line is located where the measured return loss is at a minimum measured return-loss value.

7. The microstrip antenna of claim 1, wherein the lateral offset is located where an axial ratio as a function of frequency is below the predefined return-loss value.

8. The microstrip antenna of claim 7, wherein the lateral offset is located where the axial ratio is a minimum axial-ratio value.

9. The microstrip antenna of claim 1, further comprising a transceiver connected to the single feed connection.

10. A method comprising:

drilling two apertures on opposite sides of a center of a rectangular radiating patch for a microstrip antenna, wherein a virtual line is located between two opposite corners of the radiating patch and passes through a center point of the radiating patch and between the two apertures;

determining a point on the virtual line where return loss is below a predefined return-loss value, where the determining comprises:

measuring over a frequency range starting at the center of the radiating patch and then along the virtual line toward an upper right hand corner of the radiating patch; and determining the point on the virtual line at which the frequency is below the predefined return-loss value;

determining a lateral offset from the point where axial ratio is below a predefined axial-ratio value; and connecting a transceiver to the lateral offset.

11. The method of claim 10, wherein a lateral dimension and a longitudinal dimension of a dielectric substrate of the microstrip antenna are greater than a lateral dimension and a longitudinal dimension of the radiating patch.

12. The method of claim 10, wherein the microstrip antenna includes a dielectric substrate, and the dielectric substrate and the radiating patch are substantially square.

13. The method of claim 10, wherein the two apertures are substantially circular and have substantially equal dimensions.

14. The method of claim 10, wherein the point on the virtual line is located where the return loss is a minimum measured return-loss value.

15. The method of claim 10, wherein the lateral offset is located where an axial ratio as a function of frequency is below a predefined axial-ratio value.

16. The method of claim 15, wherein the lateral offset is located where the axial ratio is a minimum axial-ratio value.

17. The method of claim 10, the transceiver connected through a single feed connection.

18. The method of claim 10, wherein determining the lateral offset from the point where axial ratio is below the predefined axial-ratio value comprises:

measuring over the frequency range in a lateral direction starting from the point on the virtual line; and determining the lateral offset at which the frequency is below the pre-defined threshold for the axial ratio in decibels.

19. A microstrip antenna, comprising:

a dielectric substrate;

a rectangular radiating plate affixed to the dielectric substrate and having a center point, wherein the rectangular radiating plate defines a first aperture and a second aperture on opposite sides of the center point, each aperture having a center longitudinally aligned with the center point; and a single feed connection laterally offset from a point on a virtual line, wherein the single feed connection is further offset from a first line that passes through the center point and that is parallel to a first side of the rectangular radiating plate, wherein the single feed connection is further offset from a second line that passes through the center point and that is parallel to a second side of the rectangular radiating plate that is perpendicular to the first side of the rectangular radiating plate, wherein the virtual line is located between two opposite corners of the rectangular radiating patch and passes through the center point and between the first aperture and the second aperture, wherein the point is positioned along the virtual line where a frequency at the point is below a pre-defined measured return loss value and the frequency is measured starting at the center point and then along the virtual line toward an upper right hand corner of the radiating patch, and the single feed connection is configured to have a frequency below a pre-defined threshold for axial ratio in decibels.

* * * * *